US005927843A

United States Patent [19]

Haugaard et al.

[11] Patent Number: 5,927,843

[45] Date of Patent: Jul. 27, 1999

[54] CANOPY LIGHT AND RELATED METHOD

[75] Inventors: Eric J. Haugaard, Kenosha; Richard L. Nachtigall, Johnson Creek; Alan J. Ruud, Racine, all of Wis.

[73] Assignee: Ruud Lighting, Inc., Racine, Wis.

[21] Appl. No.: 08/899,551

[22] Filed: Jul. 24, 1997

[51] Int. Cl.[6] ..... F21S 1/02

[52] U.S. Cl. ..... 362/147; 362/263; 362/368; 248/220.21; 248/343

[58] Field of Search ..... 362/148, 152, 362/226, 147, 263, 277, 319, 365, 368; 248/343, 317, 32, 220.21, 220.22, 322, 344

[56] References Cited

U.S. PATENT DOCUMENTS

| | | | |
|---|---|---|---|
| 1,083,728 | 1/1914 | Clement | 248/317 |
| 1,511,914 | 10/1924 | Savory | 248/363 |
| 2,192,167 | 3/1940 | Bagley et al. | 248/317 |
| 3,719,818 | 3/1973 | Porter | 240/52 |
| 4,379,321 | 4/1983 | Plemmons et al. | 362/267 |
| 4,384,316 | 5/1983 | De Vos et al. | 362/147 |
| 4,488,205 | 12/1984 | Quiogue | 362/223 |
| 4,748,543 | 5/1988 | Swarens | 362/147 |
| 4,937,718 | 6/1990 | Murray | 362/141 |
| 5,242,269 | 9/1993 | Chang | 416/244 |
| 5,562,340 | 10/1996 | Lovell | 362/147 |
| 5,713,157 | 2/1998 | Van Leeuwen et al. | 52/39 |
| 5,725,293 | 3/1998 | Wilkening et al. | 312/248 |

*Primary Examiner*—Sandra O'Shea
*Assistant Examiner*—Marshall Honeyman
*Attorney, Agent, or Firm*—Jansson, Shupe, Bridge & Munger, Ltd.

[57] ABSTRACT

A canopy light has a housing with a lower portion terminating in an opening, and also has a reflector in the housing. In the improvement, the lower housing portion includes a pair of spaced mounting members and the reflector includes a mounting lip affixed below the mounting members. The reflector body extends above the mounting members and is dimensioned to permit the reflector to be removed downwardly through the housing opening. A ballast assembly is above the reflector and is mounted on ballast supports inside the housing. The ballast assembly platform and the ballast supports are configured so that the ballast assembly can be lifted upwardly away from the supports (preferably without having to remove or loosen any fasteners) and then lowered downwardly through the housing opening. A new method for servicing a ballast assembly using access only through the housing opening (i.e., without having to gain access to the top of the housing) is also disclosed.

12 Claims, 14 Drawing Sheets

CANOPY LIGHT AND RELATED METHOD

FIELD OF THE INVENTION

This invention relates to illumination and, more particularly, to illumination apparatus used with static structures, e.g., gasoline filling station canopies.

BACKGROUND OF THE INVENTION

Some gasoline filling stations are constructed so that the fuel dispensers (often referred to as gas pumps) and the people using such dispensers are exposed to the elements. Any one who has pumped gasoline in a rainstorm knows how unpleasant this can be.

At least because of the transition from full service to self service, more-informed filling station construction includes a broad canopy over the pumps and the drive area on which the vehicle is parked for fueling. And designers and owners of such stations have long realized that sales are improved if the station looks "inviting" and offers fine visibility while the vehicle is being fueled. Good canopy lights are indispensible to those purposes.

Preferably, a canopy light illuminates both the vehicle being fueled and the pump from which fuel is being dispensed. Certainly the latter is important, given the fact that modern fuel dispensers require a customer to select, in proper sequence, a number of buttons indicating payment preference, payment location, and octane of fuel to be pumped.

The luminaire lens and mounting frame disclosed in U.S. Pat. No. Des. 375,379 (DiCola et al.) is understood to be used as a canopy light. While such light is generally satisfactory for the purpose, it is not without disadvantages.

One is that the downwardly-extending prismatic lens and the placement of the lamp with respect to such lens causes the light to exhibit what is perceived as significant "glare." That is, light beams shine directly into the eyes of a motorist entering the station. At the least, glare is disconcerting and for some human vision conditions, glare can modestly impair one's ability to see.

And that is not all. The DiCola et al. light holds a lamp in a downwardly-extending direction and does so using a lamp socket extending upwardly above the reflector and significantly above the lens. A box above the reflector contains the ballast components and has a hole through one box wall which fits around the lamp socket. Seemingly, one must gain access to the top of the light in order to service the ballast components.

The DiCola et al. light has two hooks at the frame for supporting the lens-ring-and-lens assembly on rods when such assembly is swung downwardly for re-lamping. It is understood that the rods and hooks are configured in a way that permits lifting off the assembly for any angular position thereof.

A new canopy light which addresses these concerns would be an important advance in the art.

OBJECTS OF THE INVENTION

It is an object of the invention to provide a new and improved canopy light and related method which overcomes some of the problems and shortcomings of the prior art.

Another object of the invention is to provide an improved canopy light which substantially eliminates or at least dramatically reduces glare for motor vehicle drivers at gasoline filling stations.

Another object of the invention is to provide an improved canopy light which is easy to re-lamp.

Yet another object of the invention is to provide an improved canopy light, the ballast assembly of which is easy to service.

Another object of the invention is to provide an improved canopy light, the components of which are readily accessible from beneath the light.

Still another object of the invention is to provide an improved canopy light configured to help prevent the cover from inadvertently falling therefrom during service.

Another object of the invention is to provide a new method for servicing a canopy light including the ballast assembly thereof. How these and other objects are accomplished will become apparent from the following descriptions and from the drawings.

SUMMARY OF THE INVENTION

The invention relates a canopy light and to improvements which favorably affect the ease with which service personnel can service the ballast assembly, re-lamp the light and the like. The improvements involve a canopy light of the type having (a) a housing with a lower portion terminating in an opening, and (b) a reflector in the housing.

In one aspect of the invention, the lower housing portion includes a pair of mounting members spaced apart by a first dimension. The reflector includes a mounting lip affixed below (rather than above) and to the mounting members and also has a body extending above such mounting members. The body has a second dimension adjacent to the mounting members which is less than the first dimension. The reflector is thereby permitted to be removed downwardly through the opening rather than having to gain access to the top of the light.

As will become apparent, easy removal of the reflector permits the ballast assembly to also be easily removed from below, rather than above, the light. The ballast assembly is mounted in the housing and includes a tray or platform having a first edge engaging and supported by a first ballast support. Such support is open to freely permit inserting the first edge into the bracket opening and removing such first edge from the support. In a specific embodiment, the first ballast support is embodied as a C-shaped bracket having a pair of spaced ledges attached to a bracket panel and also having an opening between the ledges.

A second edge of the platform is coupled to a second ballast support by a pin-and-aperture device. In a highly preferred embodiment, the second support has two spaced, upstanding pins and the second edge has two apertures located and sized to receive the pins when the assembly is lowered onto the support. Most preferably, the pin-and-aperture device includes a frictional member co-acting between the pin and the second edge, thereby permitting the second edge to be lifted upwardly away from the second ballast support only by overcoming frictional force. That is, no fasteners need be loosened or removed. The ballast assembly includes a capacitor and a transformer and, most preferably, the transformer is adjacent to the second edge, i.e., that edge which is first lifted to remove the assembly from the housing.

In another aspect of the invention, the housing lower opening defines a plane having a maximum dimension. The platform of the ballast assembly has a lateral dimension less than the maximum dimension, thereby permitting the ballast assembly to be removed downwardly through the opening.

In yet another aspect of the invention, the reflector includes an upper hole for receiving a lamp therethrough and the reflector mounting lip and the hole define a height therebetween. In a very-specific embodiment, such height is about 7.67 inches, i.e., about 49.5 cm. A lamp is in the reflector and has a light-emitting structure, e.g., a glowing filament or a light-emitting arc, spaced above the mounting lip by a dimension which is in the range of 40% to 65% of the reflector height. In the aforesaid very-specific embodiment, such spacing is in the range of about 3 to 5 inches (about 7.6 cm. to 12.7 cm.) above the mounting lip. Most preferably, such spacing is about 4 inches, i.e., about 10.2 cm.

A primary use for the new light is in an overhead canopy of the type found at gasoline filling stations, convenience stores and the like. The canopy light includes a frame around the opening and such frame is just below and substantially flush with the lower canopy surface.

A cover is mounted with respect to the frame and the latter includes at least one retention device, e.g., an open-topped hook or the like, having a terminus spaced from the canopy lower surface by a clearance distance measured along a vertical clearance axis. The cover includes a retention member comprising, in a specific embodiment, a bar. Such retention member is affixed to and extends between a pair of spaced lugs and engages the retention device.

The retention member has a first thickness measured along a first axis and such first thickness is greater than the clearance distance. The retention member also has a second thickness measured along a second axis which, in the preferred embodiment, is about normal to the first axis. Such second thickness is less than the clearance distance.

When the cover is hanging downwardly from the retention device in a repose position and at an exemplary angle of 80° to 90° to the horizontal frame, the first axis is about parallel to the clearance axis. The cover is prevented from being disengaged from the retention device. This arrangement provides positive cover retention and helps prevent inadvertent dropping of the cover when servicing the light. And when the cover is swung to a lift-off position at an exemplary angle of, e.g., 140° to 160° away from the horizontal frame, the second axis is about parallel to the clearance axis and the cover may be disengaged from the retention device.

The aforedescribed configuration requires a person servicing the canopy light to intentionally swing the cover to the lift-off position—such cover otherwise hangs in its repose position after being released from the frame—before such cover can be removed. But having done so, the cover is easily removed without loosening or removing fasteners or the like. The second edge and the second ballast support are coupled to one another by a pin-and-aperture device permitting the second edge to be lifted upwardly away from the second ballast support.

A new method for servicing the ballast assembly includes the steps of moving the cover downwardly away from the opening and then withdrawing the reflector downwardly through the opening. The ballast assembly is then detached from the housing and lowered downwardly through the opening.

In a more specific aspect of the method, the mounting lip is affixed below the mounting member by fasteners. The withdrawing step includes loosening the fasteners. After the reflector is withdrawn from the housing, the ballast assembly is detached. Such detaching step includes lifting the ballast assembly upwardly away from the ballast supports.

More specifically, the housing has a side wall and the ballast assembly has a long axis which, when the assembly is mounted, is generally perpendicular to the side wall. The lowering step is preceded by the step of rotating the ballast assembly within the housing. Most typically, the ballast assembly is rotated so that the long axis is generally parallel to the side wall. So rotated, the ballast assembly can be removed "endwise" from the housing.

Further details of the invention are set forth in the following detailed description and in the drawings.

DETAILED DESCRIPTIONS OF PREFERRED EMBODIMENTS

Figure 1:
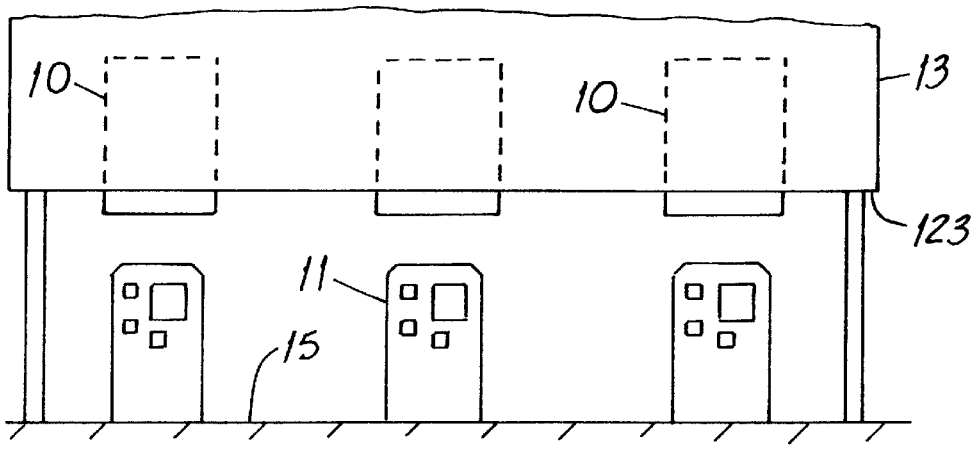
FIG. 1 is a representative elevation view of a gasoline filling station equipped with a canopy into which the new canopy light is fitted.

Before describing the new canopy light 10 and method, it will be helpful to have a better understanding of one way in which the light 10 is used. FIG. 1 shows a gasoline filling station having several fuel dispensers 11 and a canopy 13 mounted at an elevation above such dispensers 11. Each canopy 13 has one or more lights 10 mounted in it. Properly mounted (in a way that is known in the art), the lights 10 illuminate the dispensers 11, the vehicle drive 15 and any vehicle parked on such drive 15.

Referring also to FIGS. 2, 3, 4 and 6 the new canopy light 10 will now be described. Such light 10 includes a rectangular housing 17 having four walls 19, 21, 23, 25 and a housing top cover 27. Any two contiguous walls, e.g., walls 19 and 21, are perpendicular to one another. The cover 27 has a downwardly-extending perimeter flange 29 which overhangs the walls 19, 21, 23, 25 and the cover 27 includes a perimeter seal (not shown) which seals against the upper edges of the walls 19, 21, 23 and 25.

A reflector 31 is in the housing 17 and reflects light emanating from a lamp 33 extending through an upper hole 35 formed in the reflector 31. The lamp 33 is threaded to a socket 37 and is supported by and suspended below a ballast assembly 39, the platform 41 of which is supported by first and second ballast assembly supports 43 and 45, respectively. The lower housing opening 47 is bounded by a frame 49 to which is attached a lower cover 51 having a lens mounted thereon.

More particularly, the lower housing portion 53 terminates in an opening 47 defined in part by a pair of mounting members 55 spaced apart by a first dimension D1. The reflector 31 includes a mounting lip 57 affixed below (rather than above) and to the mounting members 55 by fasteners 59.

The reflector 31 also has a body 61 extending above such mounting members 55. Such body 61 has a second dimension D2 adjacent to the mounting members 55 which is less than the first dimension D1. The reflector 31 and housing 17 are thereby configured to permit the reflector 31 to be removed downwardly through the opening 47 rather than having to gain access to the top of the light 10 for reflector removal.

Figure 7:
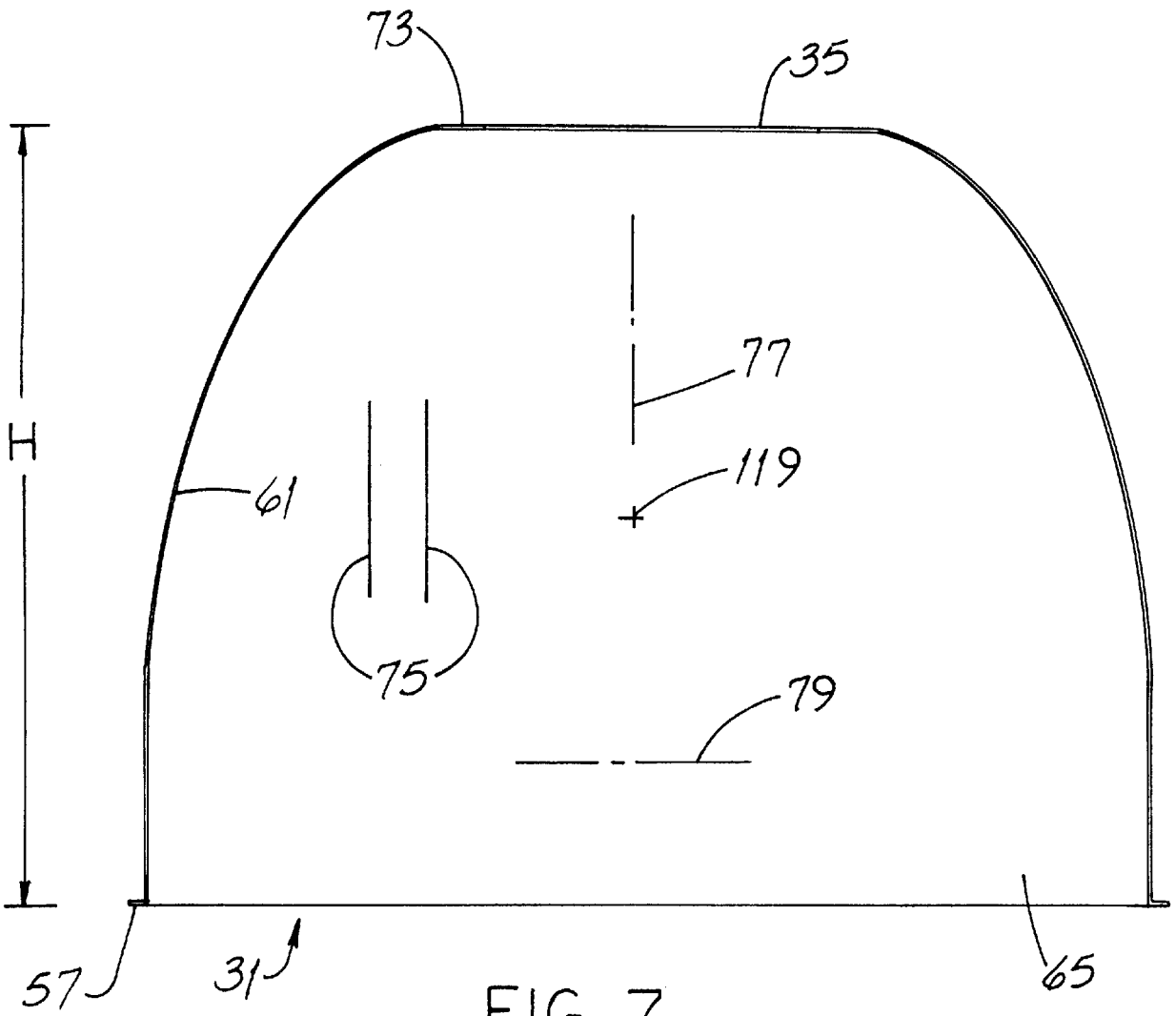
FIG. 7 is an elevation view of an exemplary reflector.
Figure 8:
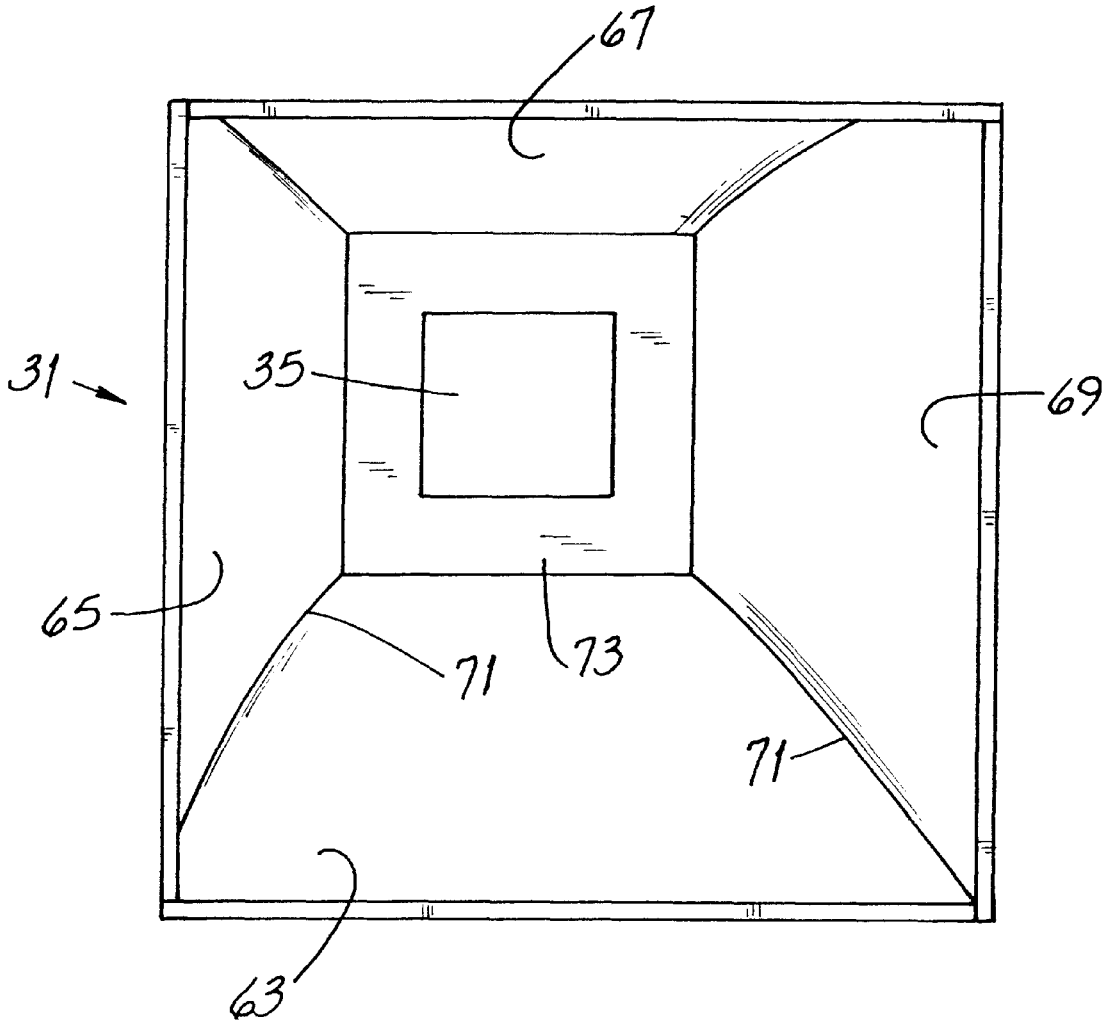
FIG. 8 is a view looking upwardly into the reflector of FIG. 7.
Figure 9:
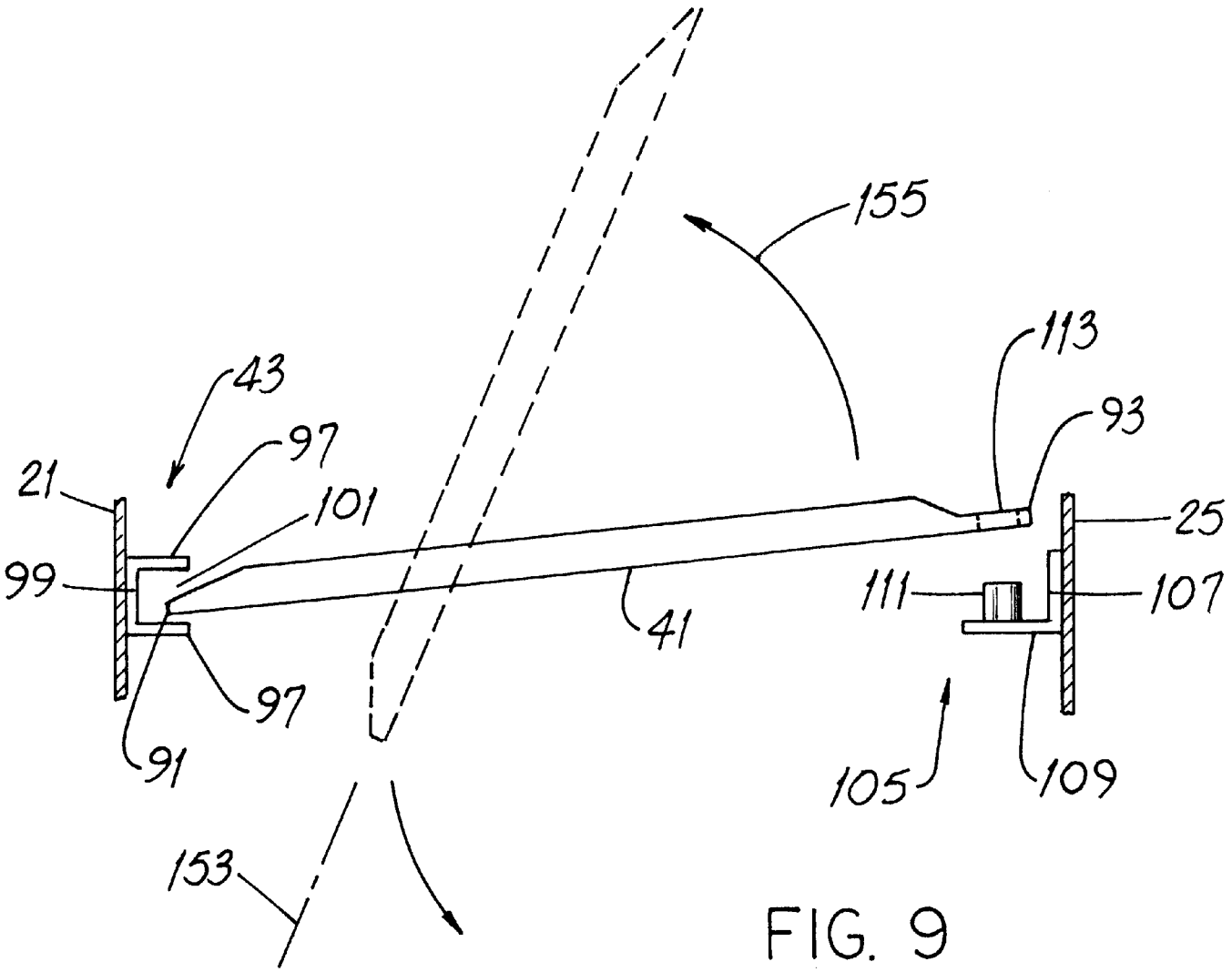
FIG. 9 is an elevation view showing the ballast assembly platform and supports therefor. A position of the platform is shown in solid outline and another position of such platform is shown in dashed outline.
Figure 10:
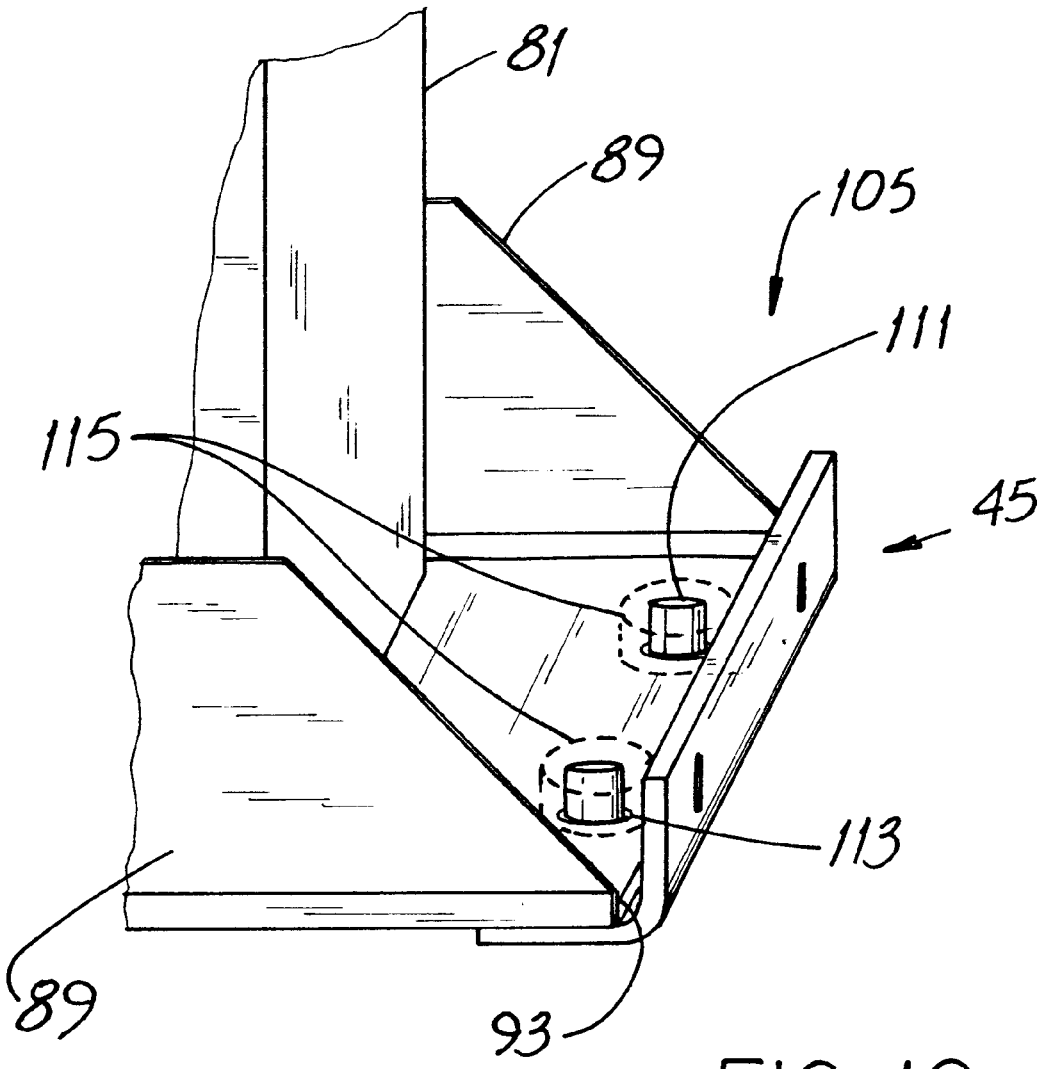
FIG. 10 is a perspective view of the second end edge of the ballast assembly platform and its support. Parts are broken away and surfaces of other parts are shown in dashed outline.
Figure 12:
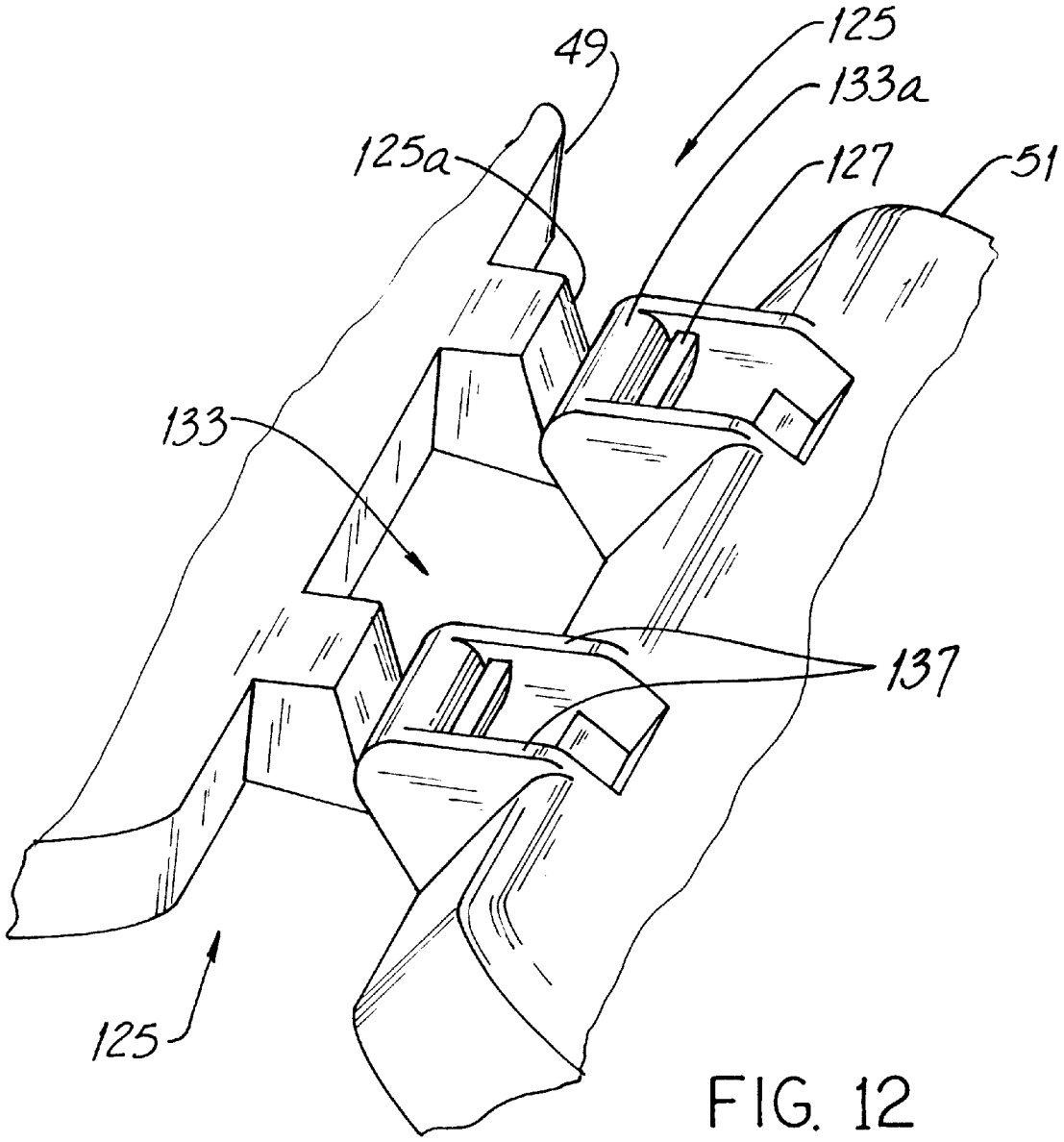
FIG. 12 is a perspective view of the frame of the canopy light and the cover swung away therefrom to a cover lift-off position.

Referring now to FIGS. 7 and 8, a specific reflector 31 suitable for use in the light 10 has four curvilinear side panels 63, 65, 67 and 69, and adjacent airs, e.g., the pair comprising panels 63, 65, are contiguous along joint lines 71. The side panels 63, 65, 67, 69 are bounded at their tops by a substantially flat top panel 73 having the hole 35 therethrough.

As to panel and reflector shape, any two spaced-apart lines along a panel, e.g., lines 75 along panel 65, are parallel to one another and to a vertical plane 77. That is to say, the panels 63, 65, 67, 69 are not curved in a horizontal direction but only in a vertical direction. Describing it another way, the shape defined by the intersection of the four panels 63, 65, 67, 69 and a horizontal plane 79 parallel to the mounting members 55 is square. And it should be appreciated that the aforedescribed reflector 31 is only an example of a reflector configuration useful in the light 10.

Referring now to FIGS. 3, 4, 5, 9, 10 and 11, the ballast assembly 39 is mounted in the housing 17 and includes a platform 41 having lamp-powering components such as a transformer 81 and a capacitor 83 mounted thereon. Most preferably, the transformer 81 is adjacent to the second edge 93. In a specific embodiment, the platform 41 has a flat floor 87 and a pair of upwardly-turned side rails 89.

Figure 11:
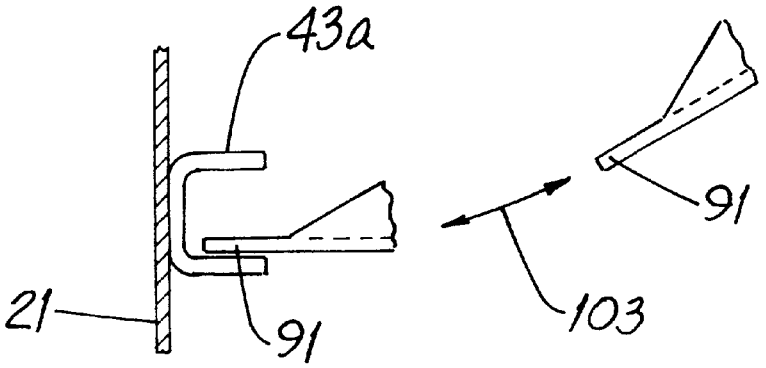
FIG. 11 is an elevation view showing the first end edge of the ballast assembly platform and its support. The first end edge is shown in solid outline in two alternate positions. Parts are broken away and other parts are shown in section.

The platform 41 also has a first end edge 91 and a second end edge 93. The first edge 91 engages and is supported by a first ballast support 43. In a specific embodiment, the support 43 is embodied as a C-shaped bracket **43*a* having a pair of spaced, horizontal ledges 97 attached to a vertical bracket panel 99, the latter being attached to the interior surface of a housing wall, e.g., wall 21. There is an opening 101 between the ledges 97 to freely permit inserting the first edge 91 into the bracket opening 101 and removing such first edge 91 from the support 43 as shown in FIG. 11 and as represented by the arrow 103**.

The platform second edge 93 is coupled to a second ballast support 45 by a pin-and-aperture device 105. In a highly preferred embodiment, the device 105 includes a vertical bracket panel 107 affixed to the wall, e.g., wall 25, opposite that wall to which the bracket panel 99 is attached. A ledge 109 extends horizontally from the bracket panel 99 and has two spaced, upstanding pins 111 affixed thereto. The second edge 93 of the platform 41 has two apertures 113, each located and sized to receive a respective pin 111 therethrough when the assembly 39 is lowered onto the support 45.

Most preferably, the pin-and-aperture device 105 includes a pair of frictional members 115, each co-acting with a respective pin 111. Such configuration permits the second edge 93 to be lifted upwardly away from the second ballast support 45 only by overcoming frictional force. That is, no fasteners need be loosened or removed.

Figure 2:
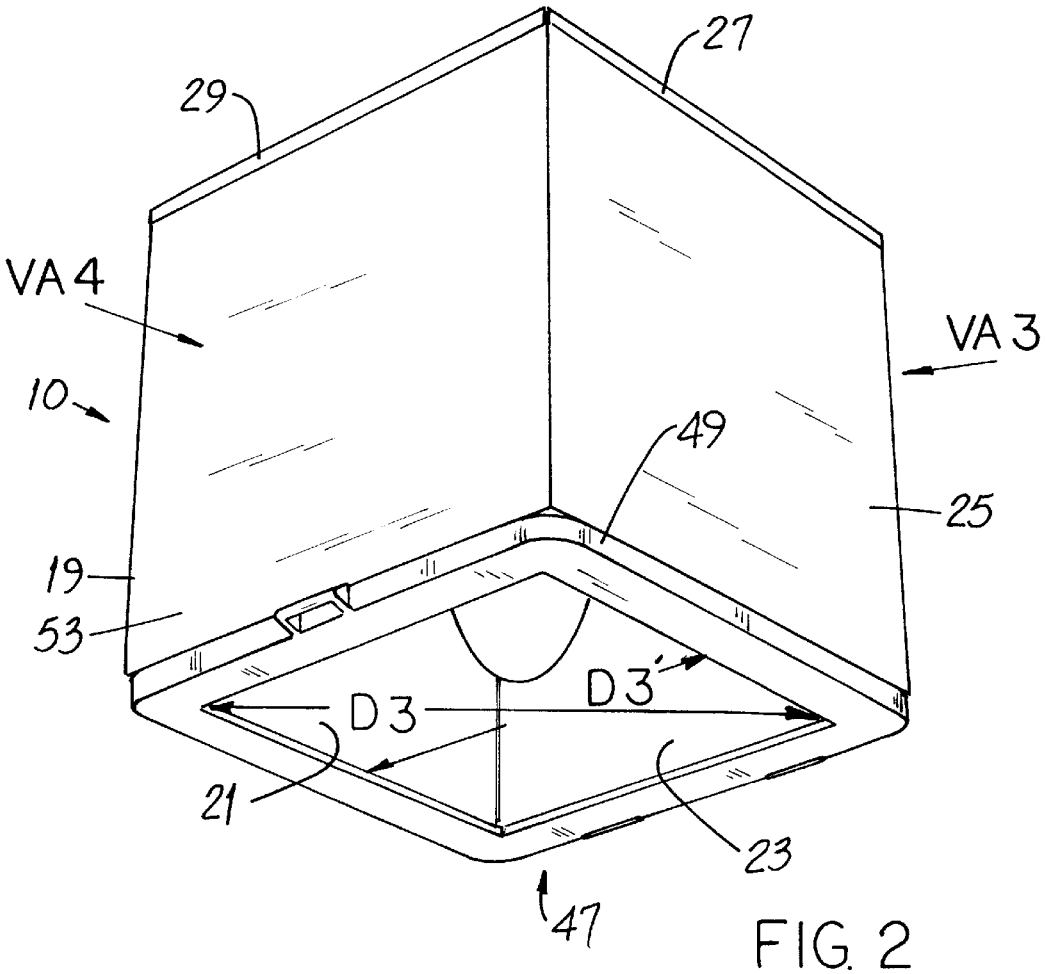
FIG. 2 is a perspective view of the new canopy light.
Figure 3:
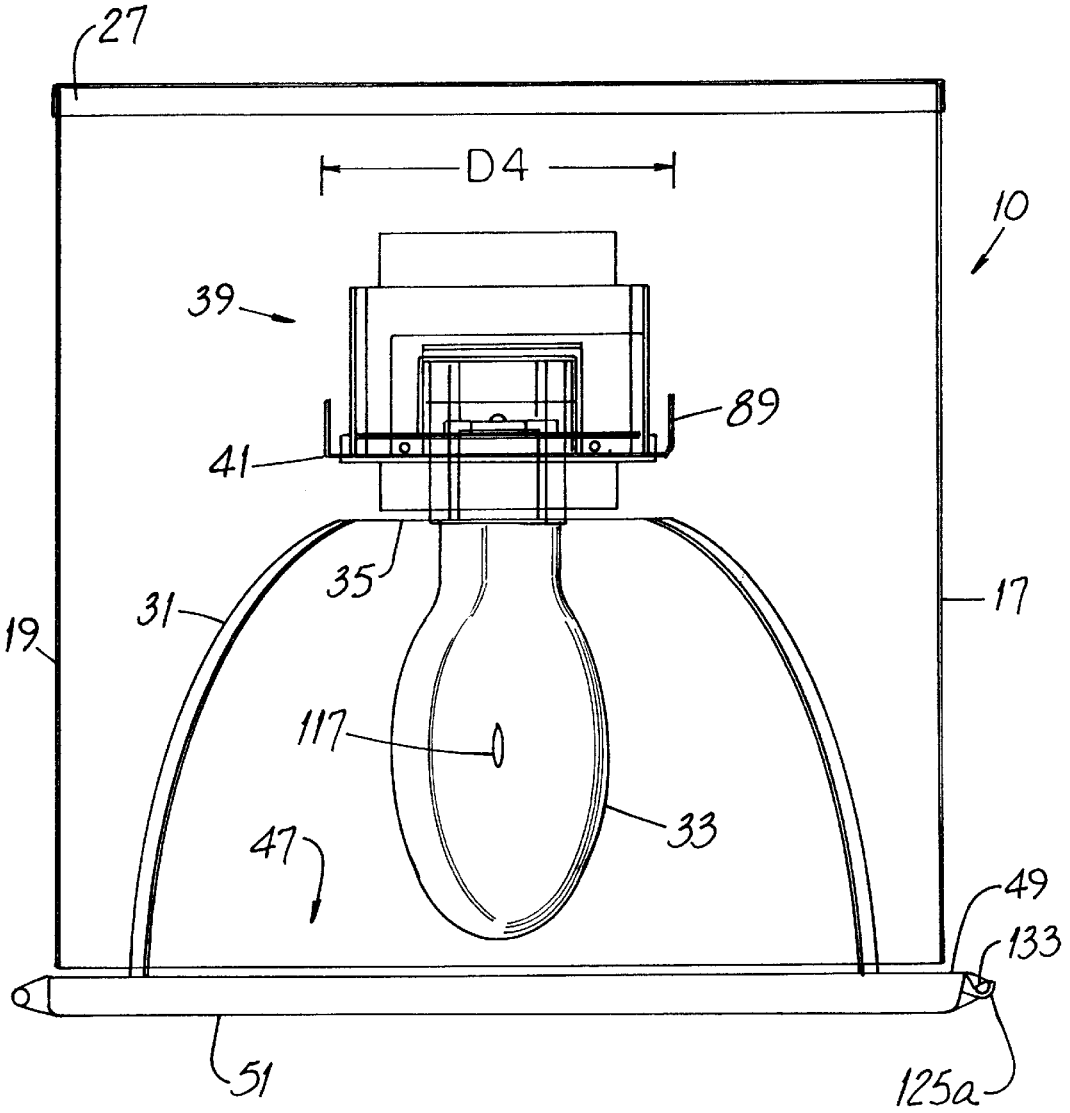
FIG. 3 is an elevation view, partly in phantom of the canopy light of FIG. 2 taken along the viewing axis VA3 thereof.
Figure 4:
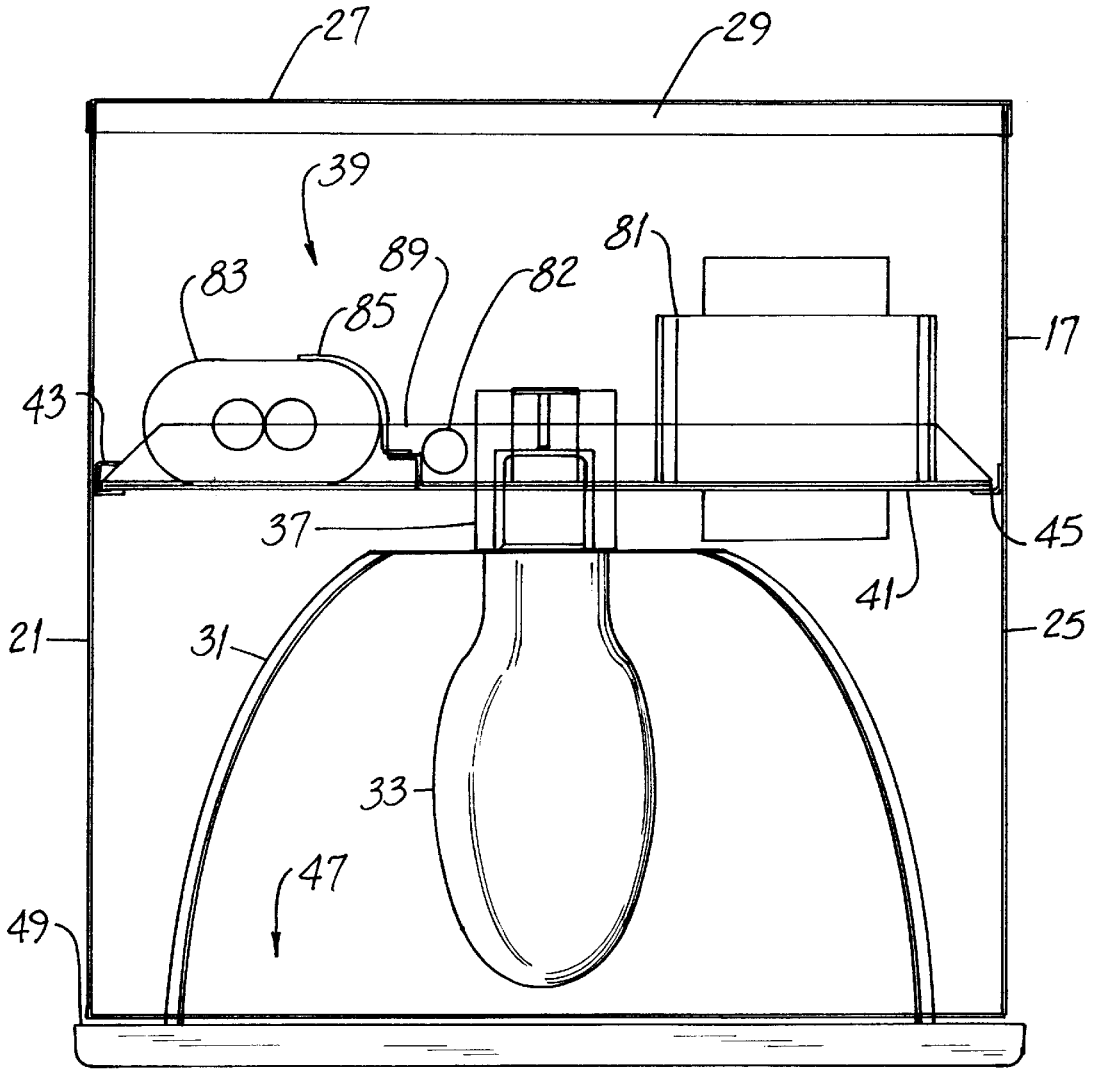
FIG. 4 is an elevation view, partly in phantom of the canopy light of FIG. 2 taken along the viewing axis VA4 thereof.
Figure 5:
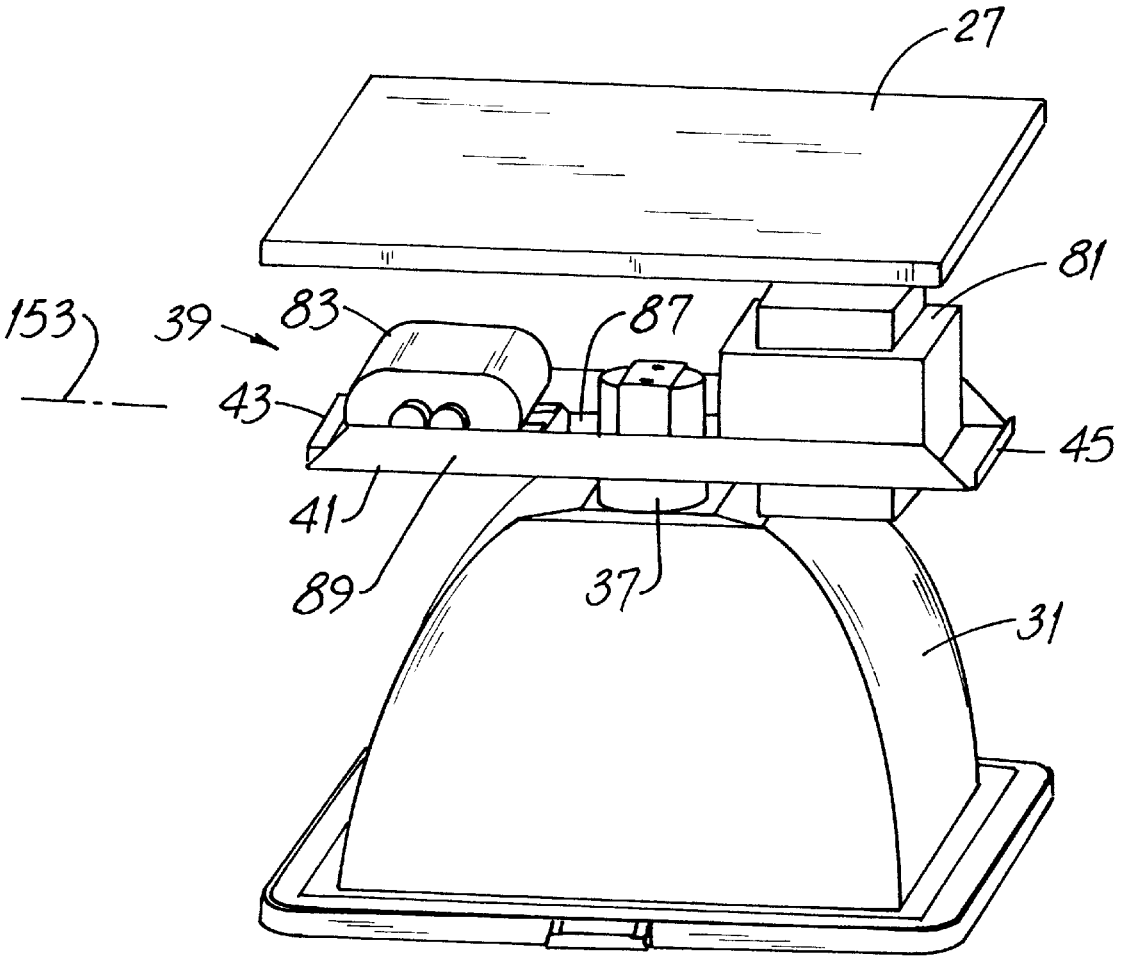
FIG. 5 is a perspective view of the new canopy light with the four-wall housing omitted.
Figure 6:
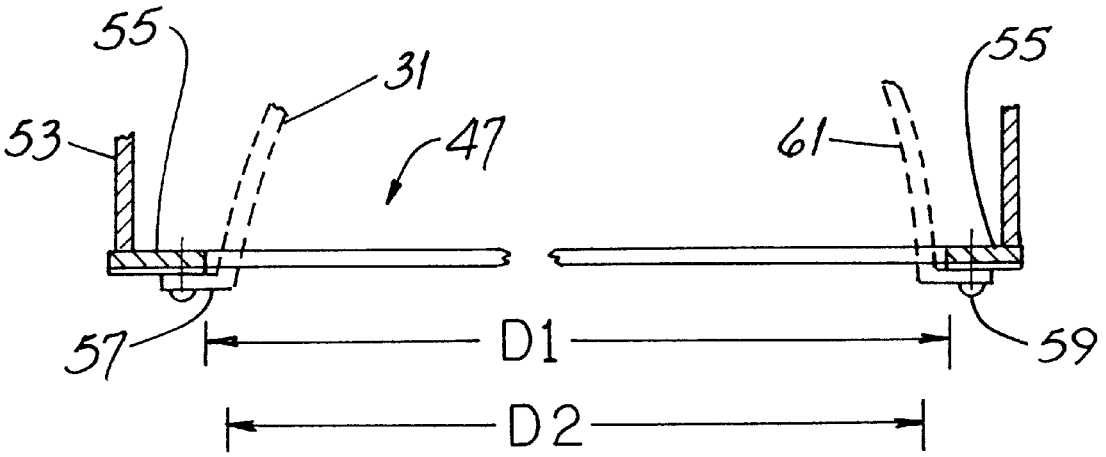
FIG. 6 is an elevation view, partly in section, showing the mounting and dimensional relationship of the housing lower portion and the reflector. Parts are in section, surfaces of other parts are shown in dashed outline and parts are broken away.

Referring next to FIGS. 2 and 3, the housing lower opening 47 defines a plane having a maximum dimension D3 or D3', depending upon how such dimension is measured. The platform 41 of the ballast assembly has a lateral dimension D4 less than the maximum dimension D3 or D3'. Such relative dimensioning permits the ballast assembly 39 to be removed downwardly through the opening as further described below.

Referring now to FIGS. 1, 3, 4, 7 and 8, the reflector mounting lip 57 and the top panel 73 define a height H therebetween. Such height H is measured vertically when the light 10 is installed in a typical canopy 13. In a very-specific embodiment, such height H is about 7.67 inches, i.e., about 49.5 cm. The lamp 33 is in the reflector 31 and has a light-emitting structure 117, e.g., a glowing filament or a pair of electrodes having a light-emitting arc therebetween, the locus 119 of which is spaced above the mounting lip 57 by a dimension which is in the range of 40% to 65% of the reflector height H. In the aforesaid very-specific embodiment, such spacing is in the range of about 3 to 5 inches (about 7.6 cm. to 12.7 cm.) above the mounting lip 57. Most preferably, such spacing is about 4 inches, i.e., about 10.2 cm, or 50% of the reflector height H above the lip 57.

Referring next to FIGS. 1 through 5 and 12 through 15, the canopy light 10 includes a frame 49 around the opening 47. Such frame 49 is just below and substantially flush with the lower canopy surface 123.

The cover 51 is mounted with respect to the frame and the latter includes, preferably, a pair of retention devices 125, each configured as, e.g., an open-topped hook **125*a* or the like. Each device 125 has a terminus 127 spaced from the canopy lower surface 123 by a clearance distance D5 measured along a vertical clearance axis 131. The cover 51 includes a retention member 133 comprising, in a specific embodiment, a bar 133*a* having a flat surface 135 formed thereon. Such retention member 133 is affixed to and extends between a pair of spaced lugs 137 and engages a retention device 125**.

The retention member 133 has a first thickness T1 measured along a first axis 141 and such first thickness T1 is greater than the clearance distance D5. The retention member 133 also has a second thickness T2 measured along a second axis 143 which, in the preferred embodiment, is about normal to the first axis 141. Such second thickness T2 is less than the clearance distance D5.

Figure 13:
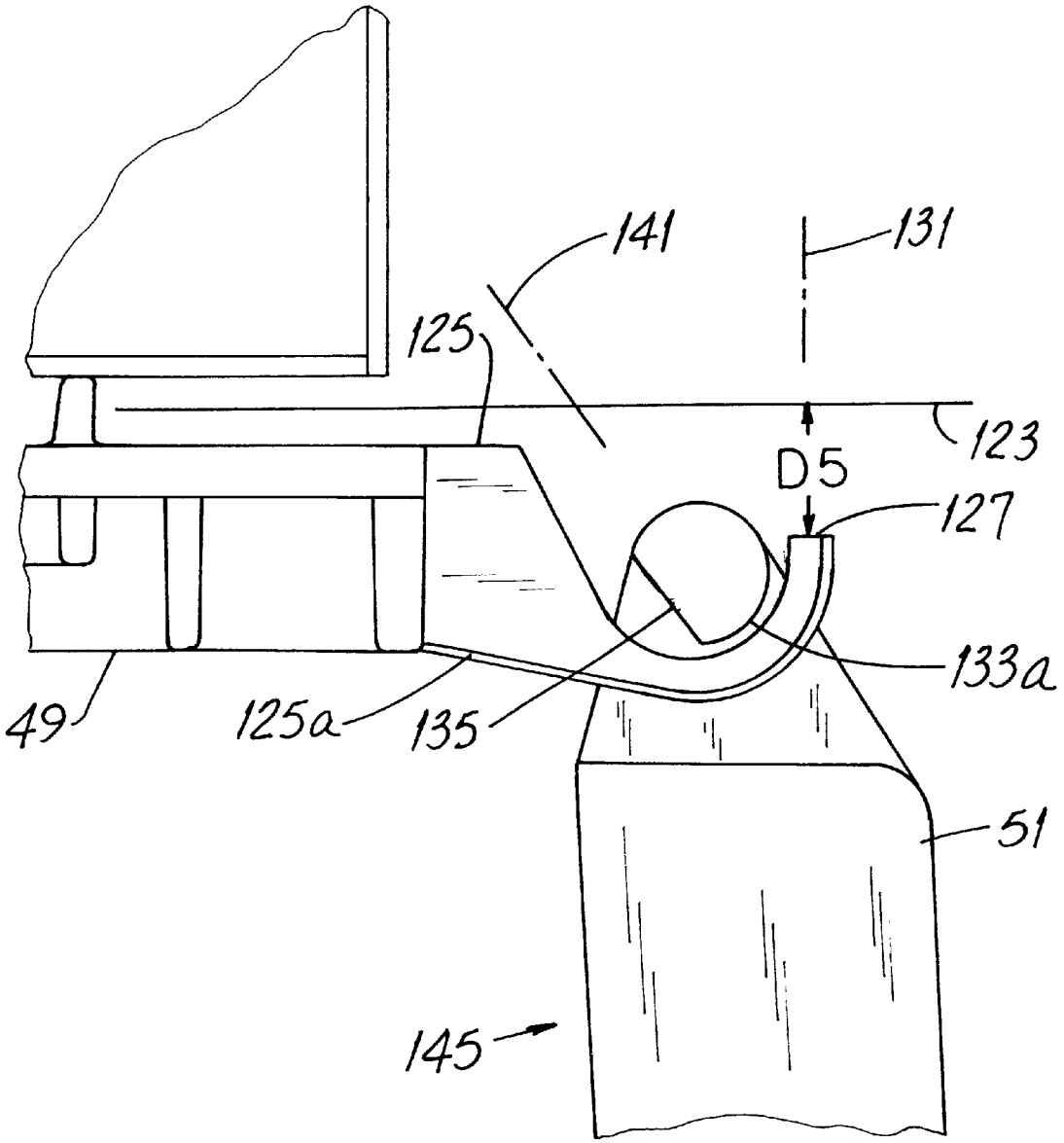
FIG. 13 is an elevation view of the frame of the canopy light and the cover swung away therefrom to a cover repose position.

When the cover 51 is hanging downwardly from the retention device 125 in a repose position 145 as shown in FIG. 13 and at an exemplary angle of 80° to 90° to the horizontal frame 49, the first axis 141 and the clearance axis 131 define an acute angle therebetween which is about 60° or less. The cover 51 is prevented from being disengaged from the retention devices 125 because the surface 123 interferes with upward movement of the retention members 133 so that such members cannot clear the terminii 127.

Figure 14:
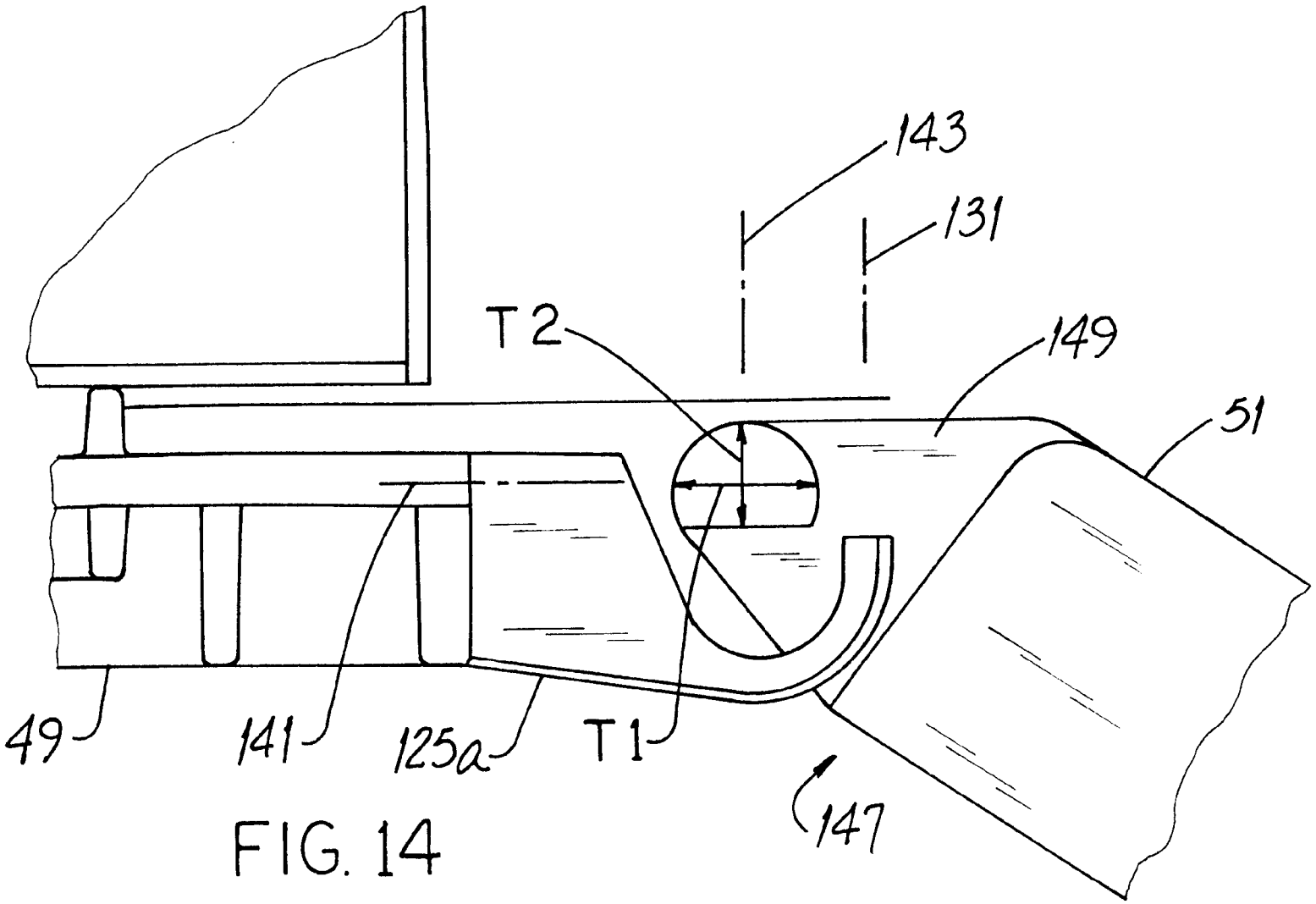
FIG. 14 is an elevation view of the frame and cover swung away therefrom to a cover lift-off position and with a cover retention member lifted above a retention device for cover detachment from the frame.
Figure 15:
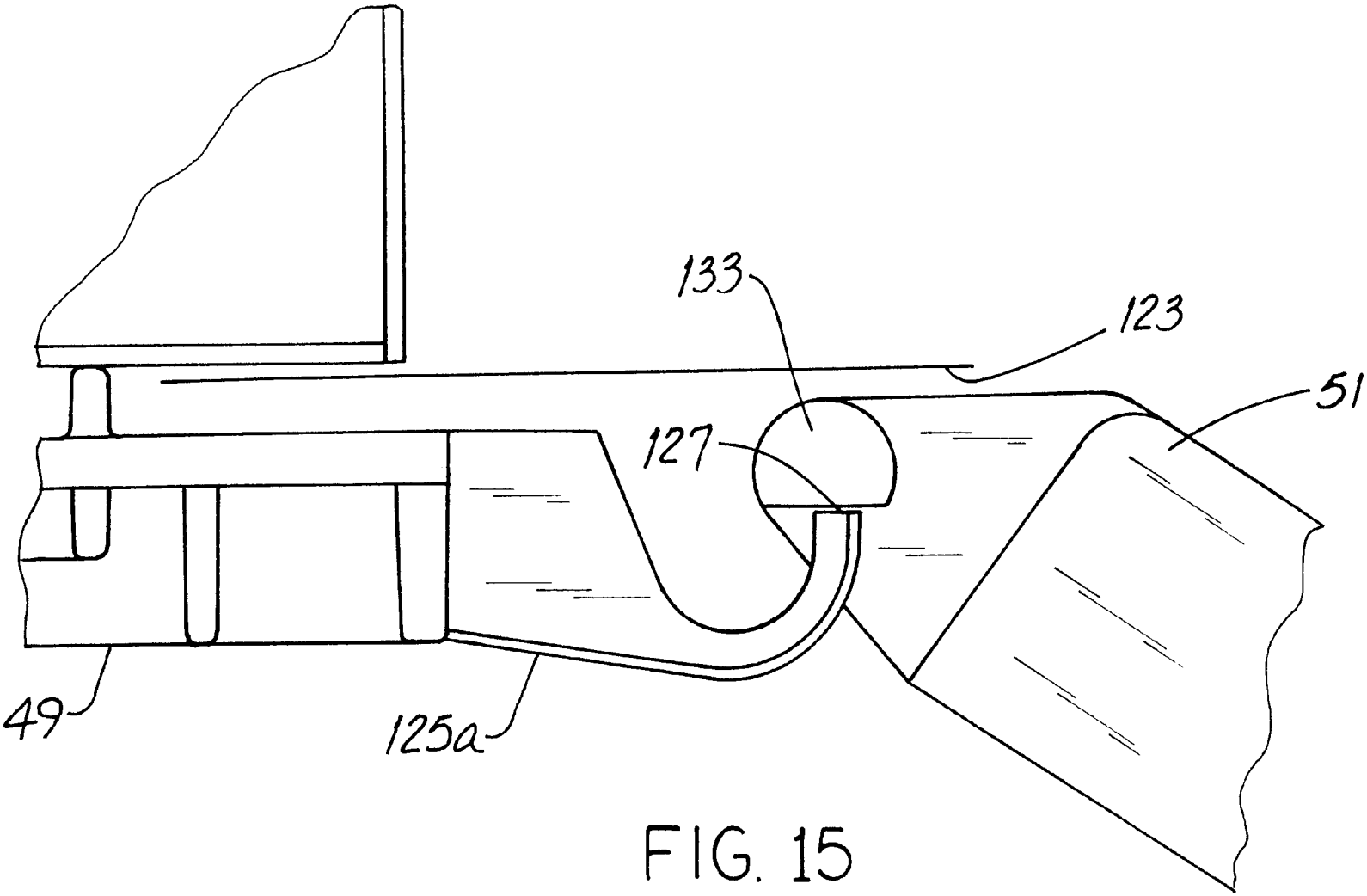
FIG. 15 is an elevation view similar to that of FIG. 14 and showing the cover being moved away from the frame for cover detachment.

Referring to FIG. 14, when the cover 51 is swung to a lift-off position 147 at an exemplary angle of, e.g., 140° to 160° away from the horizontal frame 49, the second axis 143 is about parallel to the clearance axis 131 and the cover 51 may be disengaged from the retention devices 125. This is so since when the cover 51 is so positioned, the retention members 133 can pass through the gaps 149 between the terminii 127 and the surface 123 and the cover 51 can be removed as shown in the sequence of FIGS. 14 and 15.

Referring now to FIGS. 2, 3, 4, 5, 6, 9 and 13, a new method for servicing the ballast assembly 39 will now be described. As used herein, the term "servicing" means inspecting, repairing or replacing. The method includes moving the cover 51 downwardly away from the opening 47, i.e., from the cover position shown in FIG. 3 to the cover position shown in FIG. 13.

The fasteners 59 are loosened and removed and the reflector 31 is then withdrawn downwardly through the opening 47. The ballast assembly 39 is then detached from the housing 17 and lowered downwardly through the opening 47.

The ballast assembly platform 41 has a long axis 153 which, when the assembly 39 is mounted, is generally perpendicular to the side walls, e.g., walls 21, 25. Assembly detachment is by urging the second edge 93 upwardly away from the second support 45 to a position generally as shown in solid outline in FIG. 9. As represented by the arrow 155, the assembly 39 is then further rotated within the housing 17 to a position generally as shown in dashed outline in FIG. 9, i.e., to a position such that the long axis 153 is either parallel to or at a modest acute angle to the side walls, e.g., walls 21, 25. Thereafter, the ballast assembly 39 is lowered through the opening 47 "endwise," i.e., first edge 91 first.

Figure 16:
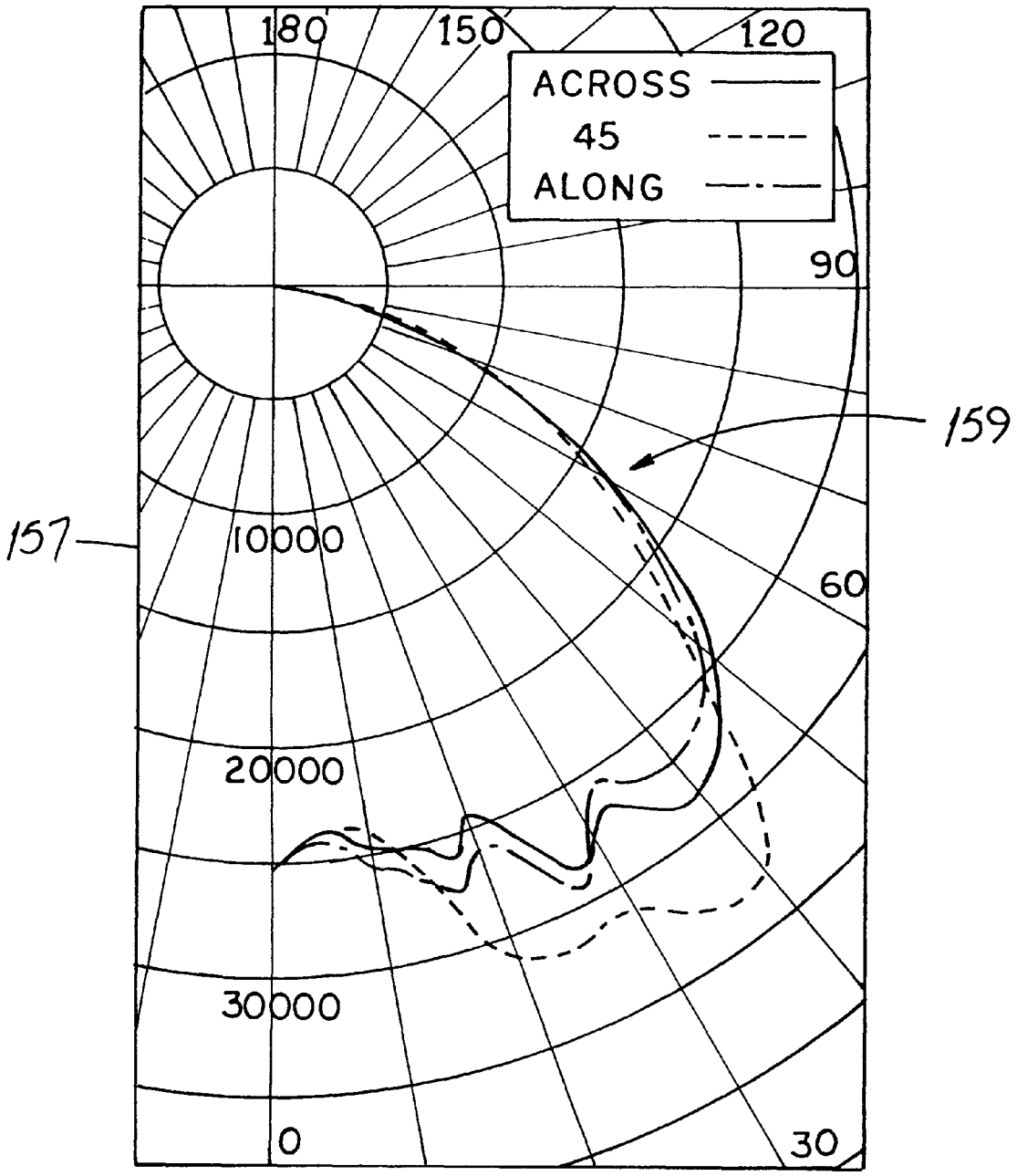
FIG. 16 is a photometric graph of showing a candela distribution curve.

Referring to the photometric graph 157 of FIG. 16, when the canopy light 10 is configured as shown and described, it provides a candela distribution curve 159 generally like that shown.

While the principles of the invention have been shown and described in connection with a few preferred embodiments, it is to be understood clearly that such embodiments are by way of example and are not limiting. As but one example, it is also effective to use downwardly-extending pins 111 on the second edge 93 of the platform 41 and form the receiving apertures 113 in the support 45.

What is claimed:

1. In a canopy light having (a) a housing with a lower portion terminating in an opening, and (b) a reflector in the housing, the improvement wherein:

the lower portion includes a pair of mounting members having a first dimension therebetween;

the reflector includes a mounting lip affixed below the mounting members and a body extending above the mounting members; and the body has a second dimension adjacent to the mounting members which is less than the first dimension, thereby permitting the reflector to be removed downwardly through the opening;

and wherein the canopy light includes a ballast assembly mounted in the housing, such assembly including:

a first edge engaging a first ballast support which is open; and a second edge coupled to a second ballast support by frictional engagement therewith.

2. The canopy light of claim 1 wherein:

the opening defines a plane having a maximum dimension;

the ballast assembly includes a platform having a lateral dimension less than the maximum dimension, thereby permitting the ballast assembly to be removed downwardly through the opening.

3. The canopy light of claim 1 wherein:

the reflector includes an upper hole for receiving a lamp therethrough, and the mounting lip and the hole define a height therebetween;

a lamp is in the reflector and has a light-emitting structure spaced above the mounting lip by a dimension which is in the range of 40% to 65% of the reflector height.

4. The canopy light of claim 2 wherein:

the reflector includes an upper hole for receiving a lamp therethrough, and the mounting lip and the hole define a height therebetween;

a lamp is in the reflector and has a light-emitting structure spaced above the mounting lip by a dimension which is in the range of 40% to 65% of the reflector height.

5. The canopy light of claim 1 wherein the ballast assembly includes a transformer mounted adjacent to the second edge.

6. The canopy light of claim 1 in combination with a canopy, the canopy light further including a frame around the opening and a cover mounted with respect to the frame and wherein:

the frame includes a retention device having a terminus spaced from the canopy by a clearance distance measured along a clearance axis;

the cover includes a retention member engaging the retention device;

the retention member has a first thickness measured along a first axis, such first thickness being greater than the clearance distance;

the retention member has a second thickness measured along a second axis, such second thickness being less than the clearance distance;

and wherein:

when the cover is hanging downwardly from the retention device, the first axis is about parallel to the clearance axis and the cover is prevented from being disengaged from the retention device; and when the cover is swung to a lift-off position, the second axis is about parallel to the clearance axis and the cover may be disengaged from the retention device.

7. A method for servicing a ballast assembly supported in a canopy light having a housing, a lower opening in the housing, a cover over the opening, a reflector in the housing and the ballast assembly mounted above the reflector, the method including the steps of:

moving the cover downwardly away from the opening;

withdrawing the reflector downwardly through the opening;

detaching the ballast assembly from the housing;

lifting the ballast assembly upwardly away from the ballast supports; and lowering the ballast assembly downwardly through the opening.

8. The method of claim 7 wherein the housing includes a pair of lower mounting members, the reflector includes a mounting lip affixed below the mounting member by fasteners and the withdrawing step includes loosening the fasteners.

9. The method of claim 7 wherein, following the lifting step and preceding the lowering step, the method includes the step of rotating the ballast assembly within the housing.

10. In combination, a canopy and a canopy light having (a) a housing with a lower portion terminating in an opening, (b) a frame around the opening, (c) a cover mounted with respect to the frame, and (d) a reflector in the housing, and wherein:

the lower portion includes a pair of mounting members having a first dimension therebetween;

the reflector includes a mounting lip affixed below the mounting members and a body extending above the mounting members;

the body has a second dimension adjacent to the mounting members which is less than the first dimension, thereby permitting the reflector to be removed downwardly through the opening;

the frame includes a retention device having a terminus spaced from the canopy by a clearance distance measured along a clearance axis;

the cover includes a retention member engaging the retention device;

the retention member has a first thickness measured along a first axis, such first thickness being greater than the clearance distance;

the retention member has a second thickness measured along a second axis, such second thickness being less than the clearance distance;

and wherein:

when the cover is hanging downwardly from the retention device, the first axis is about parallel to the clearance axis and the cover is prevented from being disengaged from the retention device; and when the cover is swung to a lift-off position, the second axis is about parallel to the clearance axis and the cover may be disengaged from the retention device.

11. A method for servicing a ballast assembly in a canopy light having a housing with a side wall, a lower opening in the housing, a cover over the opening, a reflector in the housing and the ballast assembly mounted above the reflector, and wherein:

the ballast assembly has a long axis which, when the assembly is mounted, is generally perpendicular to the side wall;

and wherein the method includes the steps of:

moving the cover downwardly away from the opening;

withdrawing the reflector downwardly through the opening;

detaching the ballast assembly from the housing; rotating the ballast assembly so that the long axis is toward the opening; and lowering the ballast assembly downwardly through the opening.

12. In combination, a canopy and a canopy light having (a) a housing with a lower portion terminating in an opening, and (b) a reflector in the housing, the improvement wherein:

the canopy light has a frame around the opening and a cover mounted with respect to the frame;

the lower portion includes a pair of mounting members having a first dimension therebetween;

the reflector includes a mounting lip affixed below the mounting members and a body extending above the mounting members; and the body has a second dimension adjacent to the mounting members which is less than the first dimension, thereby permitting the reflector to be removed downwardly through the opening;

and wherein the canopy light includes a ballast assembly mounted in the housing, such assembly including:

a first edge engaging a first ballast support which is open; and a second edge coupled to a second ballast support by frictional engagement therewith;

and wherein:

the frame includes a retention device having a terminus spaced from the canopy by a clearance distance measured along a clearance axis;

the cover includes a retention member engaging the retention device;

the retention member has a first thickness measured along a first axis, such first thickness being greater than the clearance distance;

the retention member has a second thickness measured along a second axis, such second thickness being less than the clearance distance;

and wherein:

when the cover is hanging downwardly from the retention device, the first axis is about parallel to the clearance axis and the cover is prevented from being disengaged from the retention device; and when the cover is swung to a lift-off position, the second axis is about parallel to the clearance axis and the cover may be disengaged from the retention device.

* * * * *